US009357849B2

(12) United States Patent
Grove

(10) Patent No.: US 9,357,849 B2
(45) Date of Patent: Jun. 7, 2016

(54) DYNAMIC LUMBAR SUPPORT FOR A CHAIR

(71) Applicant: James E. Grove, Marina del Rey, CA (US)

(72) Inventor: James E. Grove, Marina del Rey, CA (US)

( * ) Notice: Subject to any disclaimer, the term of this patent is extended or adjusted under 35 U.S.C. 154(b) by 201 days.

(21) Appl. No.: 14/051,251

(22) Filed: Oct. 10, 2013

(65) Prior Publication Data

US 2015/0102647 A1 Apr. 16, 2015

(51) Int. Cl.
*A47C 7/46* (2006.01)

(52) U.S. Cl.
CPC ..... *A47C 7/46* (2013.01)

(58) Field of Classification Search
CPC ..... A47C 7/46
USPC ..... 297/284.4, 452.32
See application file for complete search history.

(56) References Cited

U.S. PATENT DOCUMENTS

| | | | | |
|---|---|---|---|---|
| 2,843,195 | A * | 7/1958 | Barvaeus | 297/284.4 |
| 4,040,661 | A * | 8/1977 | Hogan et al. | 297/284.4 |
| 4,350,388 | A * | 9/1982 | Weiner | 297/284.7 |
| 4,832,401 | A * | 5/1989 | Brooks | 297/284.7 |
| 6,257,665 | B1 * | 7/2001 | Nagamitsu et al. | 297/285 |
| 6,554,360 | B1 * | 4/2003 | Wilke et al. | 297/342 |
| 6,755,467 | B1 * | 6/2004 | Chu | 297/284.1 |
| 6,938,956 | B1 * | 9/2005 | Piretti | 297/284.7 |
| 7,086,700 | B2 * | 8/2006 | Habedank | 297/378.1 |
| 7,874,618 | B2 * | 1/2011 | Kohl et al. | 297/284.4 |
| 8,272,691 | B2 * | 9/2012 | Hsuan-Chin | 297/285 |
| 2005/0275263 | A1 * | 12/2005 | Norman et al. | 297/284.4 |
| 2005/0275264 | A1 * | 12/2005 | Norman et al. | 297/284.4 |
| 2006/0061169 | A1 * | 3/2006 | Kohl et al. | 297/284.4 |
| 2008/0179930 | A1 * | 7/2008 | Harley | 297/284.7 |
| 2008/0231095 | A1 * | 9/2008 | Brauning | 297/219.1 |
| 2011/0233979 | A1 * | 9/2011 | An | 297/284.4 |
| 2014/0084653 | A1 * | 3/2014 | Mezzera | 297/285 |

FOREIGN PATENT DOCUMENTS

| | | | | |
|---|---|---|---|---|
| CH | EP 1911374 A1 * | 4/2008 | | A47C 7/46 |
| DE | EP 0591933 B1 * | 12/1995 | | A47C 7/46 |
| DE | 102004012850 * | 5/2005 | | A47C 7/46 |
| FR | WO 8504084 A1 * | 9/1985 | | A47C 1/032 |
| NO | EP 2100539 A1 * | 9/2009 | | A47C 1/03255 |
| SE | WO 2013119172 A1 * | 8/2013 | | A47C 1/03255 |
| WO | WO 2008108972 A1 * | 9/2008 | | A47C 7/46 |

* cited by examiner

*Primary Examiner* — David R Dunn
*Assistant Examiner* — Tania Abraham
(74) *Attorney, Agent, or Firm* — Morland C. Fischer

(57) ABSTRACT

A dynamic lumbar support located within the back of an office or home chair to enable a user to be seated close to a work surface (e.g., a desk or a table). The chair back rocks back and forth when the user shifts his weight backwards and forwards. The dynamic lumbar support includes a cushion back support manufactured from a resilient material that is responsive to a compressive force applied thereto when the user reclines and shifts his weight against the chair back. In particular, the cushion back support is adapted to change its shape from a relaxed convex shape at which to support the user's lower back and maintain a proper posture when the user sits erect and the chair back stands upright to a compressed flattened shape at which to support the user's back when he reclines and the chair back tilts backwards.

20 Claims, 6 Drawing Sheets

DYNAMIC LUMBAR SUPPORT FOR A CHAIR

BACKGROUND OF THE INVENTION

1. Field of the Invention

This invention relates to a dynamic lumbar support located inside the back of a chair of the kind which rocks back and forth, such as that, for example, commonly found in an office or home so that a user can be sealed close to a work surface (e.g., a desk or a table). The lumbar support is adapted to change its shape in response to a pressure applied to the chair back so as to provide support and maintain a proper posture of the user's back at all times when the chair back stands upright and the user's back is erect and close to the work surface and when the chair back rocks backwards and the user reclines away horn the work surface.

2. Background Art

A wide variety of chairs have been used in an office or at home to enable a user to be seated adjacent a work surface. In this case, the user can access a computer, a book, a writing pad, etc, which lays upon site work surface so that the user can work while seated. Some chairs are adapted to rock back and forth in response to the user shifting his weight backwards and forwards. With the chair rocked forwards, the user's back is located close to the work surface during which work can be accomplished. When the chair rocks backwards, the user's back, is correspondingly reclined and tilted away from the work surface to enable the user to relax.

A common problem with such conventional office and home chairs occurs when the chair rocks forward and the user tries to hold his back erect and close to the work surface. In particular, even when the back of the chair stands upright, the back of the user is usually spaced forwardly from the chair back. Therefore, the chair back offers no support for the user's lower back throughout those times when the user is working. Consequently, the user's back posture may suffer and, especially during long periods of work, the user may experience lower back pain and discomfort.

What would therefore be desirable is a chair which overcomes this problem so that the user's back will be adequately supported by the chair back so that a proper posture is maintained when the chair rocks forward and the user's back is erect.

SUMMARY OF THE INVENTION

In general terms, a dynamic lumbar support is disclosed to be located inside the back of a chair that has particular application for use in an office or a home so that a user can be seated adjacent a work surface (e.g., a desk or a table). The chair is of the kind that rocks back and forth when the user shifts his weight backwards and forwards. The dynamic lumbar support herein disclosed is responsive to a pressure applied by the user against the chair back. That is, the lumbar support is adapted to change its shape as the user shifts his weight in the chair. By virtue of the foregoing, the user's lower back will be supported and a proper posture maintained when the chair rocks forward and the back of the chair stands upright so that the user's back will remain erect and close to the work surface.

The dynamic lumbar support includes a resilient (e.g., foam) cushion back, support that is located inside the back of the chair. A flexible (e.g., plastic) force-receiving sheet, having a spring memory and a normally-curved (i.e., arced) configuration is bonded to the rear of the cushion back support. A rotatable sheet bending rod runs across the bottom of the force-receiving sheet to apply pressure and hold the sheet in its initially curved configuration. The bottom of the flexible force-receiving sheet is coupled to a cushion retention plate which lies below the seat, of the chair. The top of the force-receiving sheet is coupled to a back pressure-responsive rod which runs horizontally through the chair back. Opposite ends of the back pressure-responsive rod are received in respective ones of a pair of vertical guide tracks hurt are affixed to a plywood backing inside the chair back. A tension strap runs vertically through the chair back behind the cushion back support. The top of the tension snap is attached to use back pressure-responsive rod, and the bottom of the tension strap is pivotally connected at a spring-loaded hinge to one end us a tilt plate. The opposite end of the tilt plate is coupled to the existing gas cylinder receiver which projects downwardly from the seat plate.

When the chair back stands upwardly from the chair seat and the user sits erect so as to be close to the work surface, the cushion back support of the dynamic lumbar support is at rest. In this case, the back support has a convex shape which protrudes forwardly from the chair back to support the user's lower back and maintain a proper posture. At the same time, the back pressure-responsive rod lies at the bottom of the pair of vertical guide tracks. When the chair rocks back and the user reclines away front the work surface, a compressive force is generated by the user's back against the chair back. In this case, the convex cushion back support is compressed and flattened by the user's back, and the flexible, normally-curved force-receiving sheet which covers the rear of the back support is straightened so as to store energy. At the same time, the pivotal tension strap rotates rearwardly at tire hinge, whereby to cause the back pressure-responsive rod that is attached to the top of the tension strap to ride upwardly along the pair of guide tracks and vertically through the chair back. When the compressive force being applied to the chair back is terminated, the tension strap rotates forward, and the straightened force-receiving sheet recovers to its normally-curved configuration and releases its stored energy to simultaneously cause the back pressure-responsive rod to move in an opposite downward direction through the guide tracks and the previously compressed cushion back support, to expand back to its initial at rest convex shape.

DESCRIPTION OF THE PREFERRED EMBODIMENT

Figure 1:
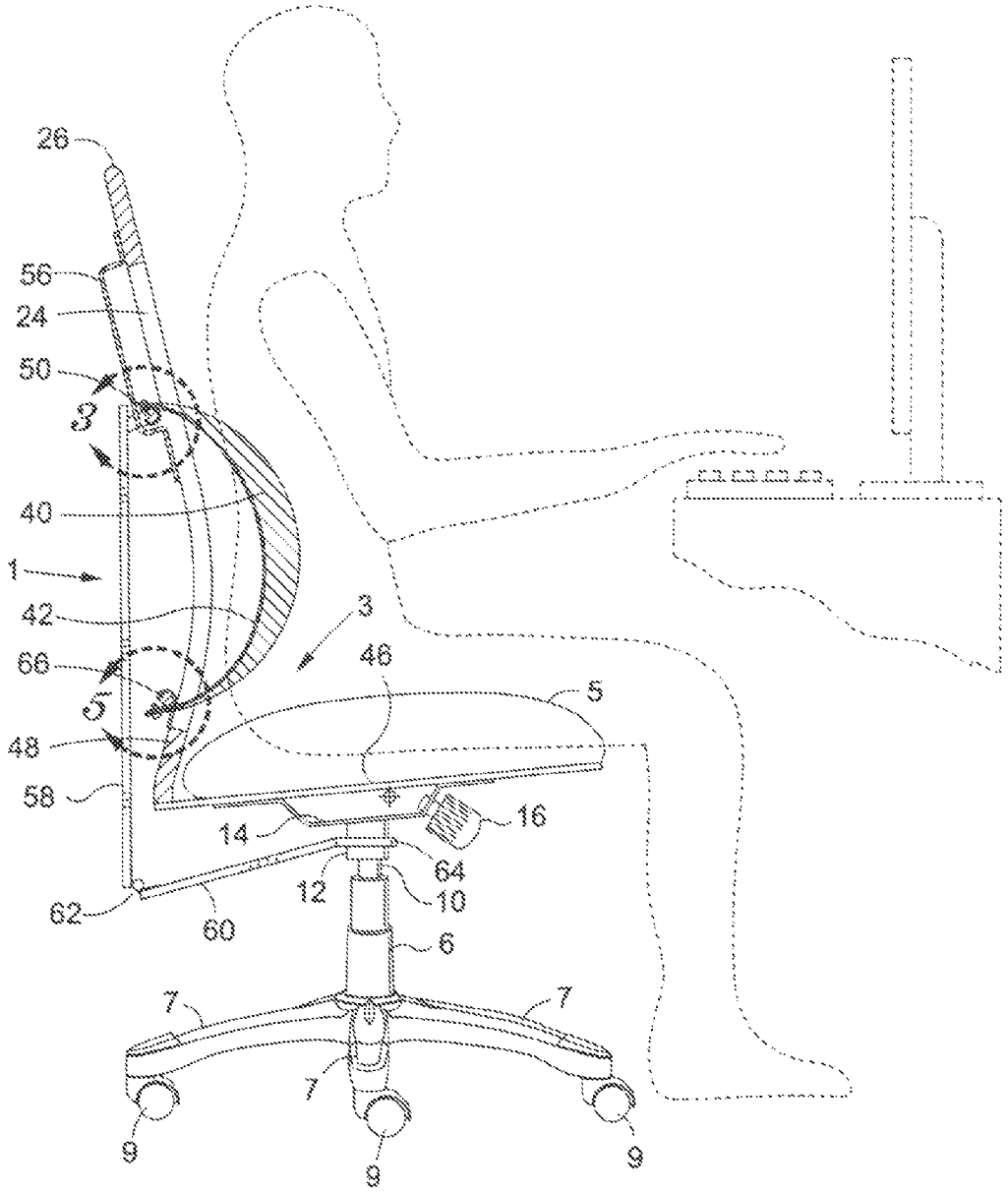
FIG. 1 is a side view of a chair having a dynamic lumbar support according to a preferred embodiment located inside the chair back and including a cushion back support having an initial sorest convex shape when a user leans forward and sits erect in the chair adjacent a work surface.

Referring concurrently to FIGS. 1-6 of the drawings, a dynamic lumbar support 1 is shown end disclosed for use with a chair 3. The chair 3 is preferably one that rocks back and forth and is of the kind that would commonly be found in an office or at home to provide a seat for one working at a desk, a table or a similar work surface. However, the specific use of the chair 3 is not to be regarded as a limitation of this invention.

Like a typical chair, the chair 3 shown in FIGS. 1-6 includes a seat 5 to support the weight of a user. The chair seat 5 is held above the ground by a base 6 having a set of outstretched legs 7 to which respective rollers 9 are attached to permit the chair 3 to be moved from place-to-place. A gas cylinder 10 extends between the base 6 and a gas cylinder receiver 12 that projects downwardly from a seat plate 14. A lever arm (not shown) cooperates with the gas cylinder 10 to enable the elevation of the seat 5 to be adjusted to suit the needs of the user. A tension adjustment knob 16 is accessible below the seat plate 14. The tension adjustment knob 16 is rotated to adjust the spring tension of the seat 5 depending upon the size and weight of the user.

The dynamic lumbar support 1 is located within the back 20 of the chair 3. As will soon be explained, the shape of the lumbar support 1 changes in response to pressure being applied thereagainst by the back of the user as the user shifts his weight forwards and back. As an important advantage of this invention, and unlike a typical borne or office chair, the lumbar support 1 is adapted to engage and support the user's back so as to maintain a proper posture and enhance comfort when the chair 3 rocks forward and the chair back stands upright to enable the user to sit erect and close to the work surface (best shown in FIG. 1). The lumbar support 1 will also comfortably support the user's back at times when the chair rocks back and the user reclines so that, the back 20 of the chair tilts away from the work surface (best shown in FIG. 2).

Figure 6:
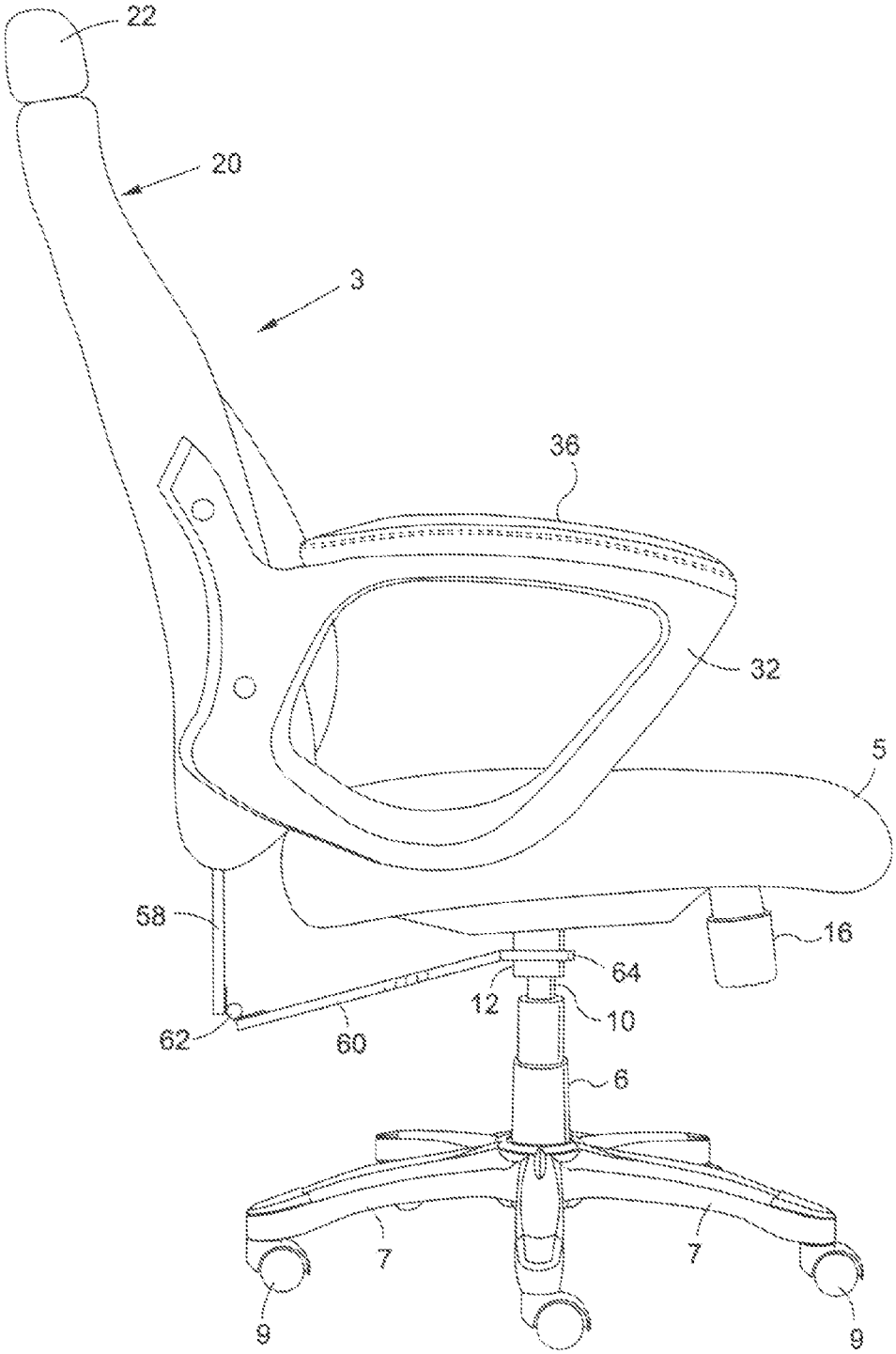
FIG. 6 is a side view of the chair shown in FIG. 1.

The back 20 of the chair 3 within which the dynamic lumbar support 1 is located stands upwardly horn the seat 5 (best shown in FIG. 6). A bead rest 22 projects upwardly from the back 20 in axial alignment therewith. The back 20 provides support for the user's back, while the head rest 22 supports the user's head and neck. Each of the back 20 and head rest 22 includes a solid (e.g., plywood) backing 24 and 26 which is surrounded by filler material and a conventional upholstered cover 28 and 29, such as that manufactured from vinyl, leather or the like (best shown in FIG. 4). An opening 30 (also best shown in FIG. 4) is formed in the backing 24 of the chair back 20 to accommodate the dynamic lumbar support 1 therethrough.

The chair 3 is shown having a pair of arms 32 and 34 located at opposite sides of the seat 5. For the chair 3 of FIGS. 1-6, the arms 32 and 34 are bolted to and extend forwardly from the back 20. However, the anus 32 and 34 may also be connected to the seat 5 or to each of the back 20 and the seat 5. An arm rest 36 is attached atop each of the pair of arms 32 and 34 upon which the arms of the user may be laid.

Details of the dynamic lumbar support 1 are now described according to a preferred embodiment of this invention. The lumbar support 1 includes a cushion back support 40 which is positioned inside the chair back 20 so as to engage the lower back of a user who is seated in the chair 3. The cushion back support 40 is manufactured from a resilient material (e.g., foam) that is adapted to be compressed and undergo a change in its shape in response to a compressive force applied thereto. The rear of the cushion, back support 40 is covered by a force-receiving sheet 42 that, is manufactured from a flexible (e.g., plastic) material which has a characteristic spring memory. The flexible sheet 42 is adhesively bonded to the cushion back support 40. The flexible sheet 42 is normally curved with, an arced configuration so as to urge the cushion back support 40 into engagement with the user's lower back. The sheet 42 is located at the rear of the plywood backing 24 adjacent the opening 30 formed therein, so that the cushion back support 40 projects ahead of sheet 42 and through opening 30 to the front of backing 24.

The cushion back support 40 of the lumbar support 1 is coupled at the bottom thereof to a flat cushion retention plate 46 that is affixed to the bottom, of the chair seat 5 above the seat plate 14. A linking arm 48 extends between the bottom of the cushion back support 40 and the cushion retention plate 46. The top of the arced flexible sheet 42 to which the cushion back support 40 is bonded is coupled to a back pressure-responsive rod 50 that extends horizontally inside the back 20 of the chair 3.

Figure 3:
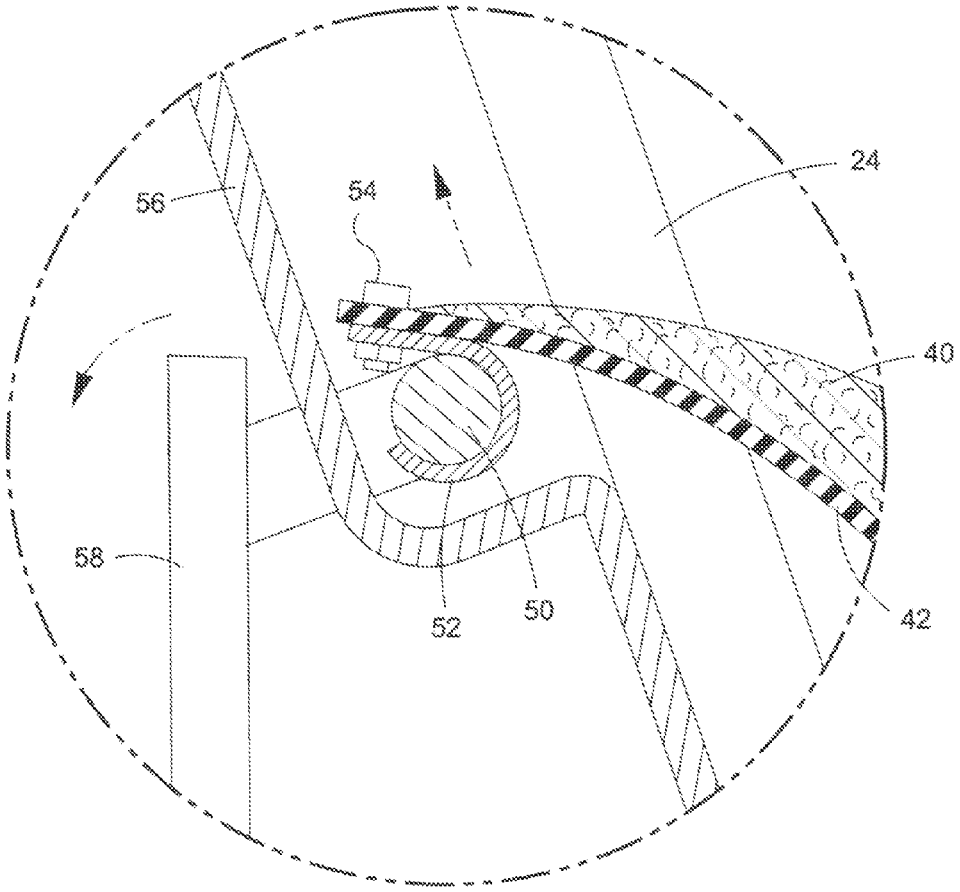
FIG. 3 is an enlarged detail of the cushion back support and a flexible force-receiving sheet to which the back support is bonded taken from the top of the dynamic lumbar support shown in FIG. 1.
Figure 4:
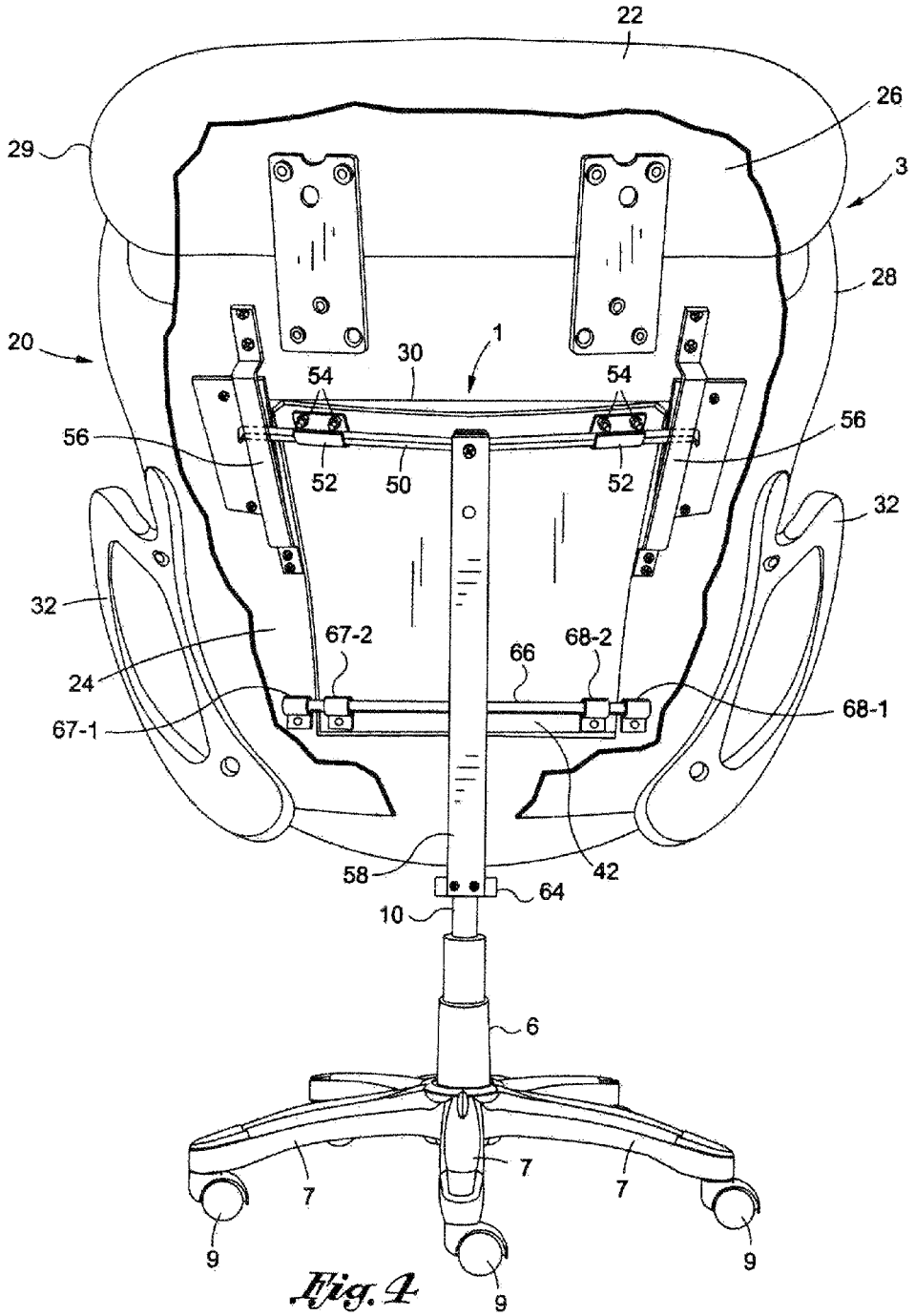
FIG. 4 is a rear view of the chair of FIG. 2 showing the dynamic lumbar support located inside the chair back and covered by decorative upholstery.

In particular, and referring specifically to FIGS. 3 and 4 of the drawings, opposite ends of the back pressure-responsive rod 50 are received by a pair of generally J-shaped brackets 52. The horizontally-excluding back pressure-responsive rod 50 is secured behind the flexible force-receiving sheet 42 which covers the rear of back support 40 by means of a pair of fasteners 54 which extend through the force-receiving sheet 42 and respective ones of the pair of brackets 52.

The horizontally extending back pressure-response rod 50 which is supported by the brackets 52 lies within a pair of generally vertical guide tracks 56. As is best shown in FIG. 4, the pair of guide tracks 56 are affixed to the plywood backing 24 inside the back 20 of the chair 3 so as to be held in spaced parallel alignment with one another. That is, one end of the rod 50 is slidably received within a first of the pair of guide tracks 56 at one side of backing 24, and the opposite end of rod 50 is slidably received in the second guide track 56 at the opposite side of backing 24. As will soon be explained, the horizontally extending back pressure-responsive rod 50 is adapted to slide up and down along the vertically extending guide tracks 56 in response to the user shifting his weight in the chair 3 and causing the chair back 20 to either stand upright or tilt back.

Figure 5:
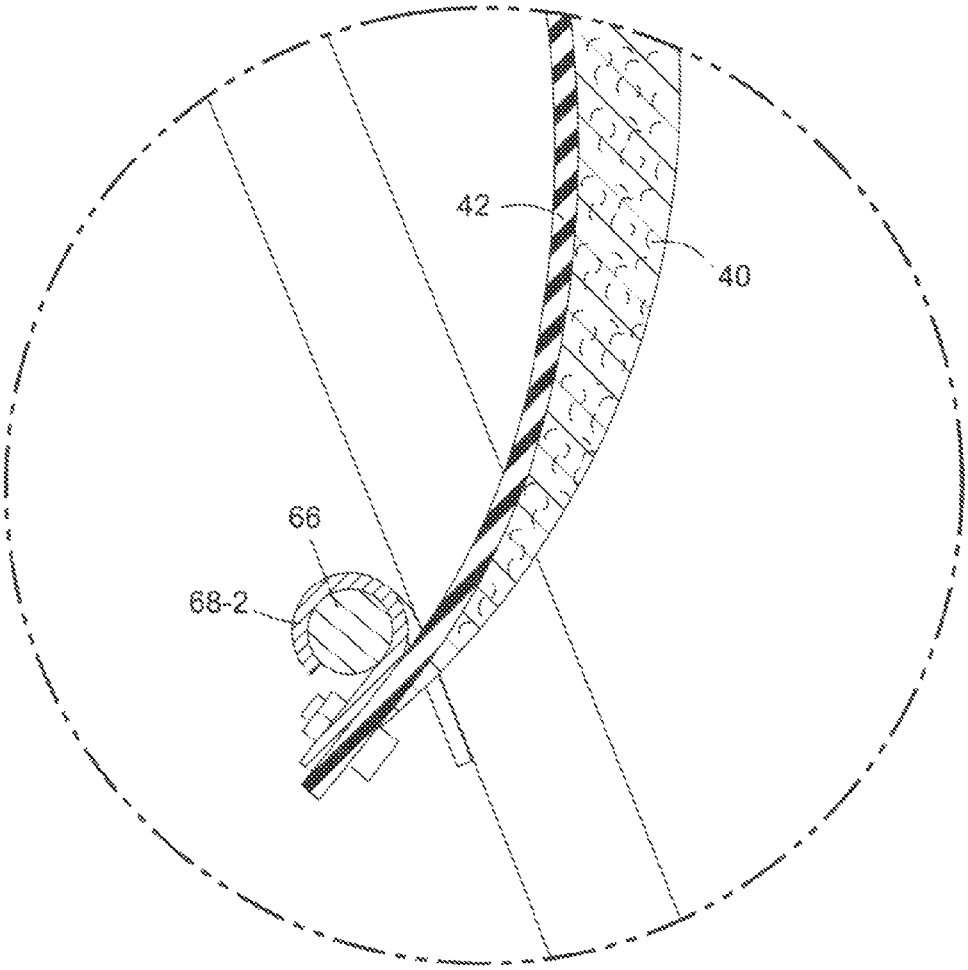
FIG. 5 is an enlarged detail of me cushion back support and the flexible force-receiving sheet taken from the bottom of the dynamic lumbar support shown in FIG. 1.

As is best shown in FIGS. 4 and 5 of the drawings, the bottom of the flexible force-receiving sheet 42 is coupled to a sheet bending rod 66 that, like the back pressure-responsive rod 50, extends horizontally inside the back 20 of the chair 3. However, while the back pressure-responsive rod 50 runs across the top of the force-receiving sheet 42, the sheet bending rod 66 runs across the bottom of sheet 42. Each of the opposite ends of the sheet bending rod 66 is received by a respective pair of cylindrical, hinges 67-1, 67-2 and 68-1, 68-2. In particular, a first hinge 67-1 and 68-1 from each pair of hinges is affixed to the plywood backing 24 of the chair back 20. A second hinge 67-2 and 68-2 from each pair of hinges is affixed to the flexible force-receiving sheet 42. All of the hinges 67-1, 67-2, 68-1 and 68-2 are axially aligned with one another so that the sheet bending rod 66 is rotatable therewithin.

The dynamic lumbar support 1 also includes a rigid (e.g., steel) tension strap 58 that is spaced behind the cushion back support 40 and runs vertically down the back 20 of the chair 3. FIG. 4 shows one end of the tension strap 58 attached to approximately the midpoint of the back pressure-responsive rod 50. The opposite end of the tension strap 58 is coupled to one end of a stationary (e.g., steel) tilt plate 60 at a pivot such as, for example, a spring-loaded hinge 62. As best shown in FIG. 6, the tension strap 58 extends downwardly through and outwardly from the bottom of the back 20 of the chair 3 so as to be pivotally connected to the lunge 62 below the chair back. The tilt plate 60 lies below the seat plate 14, such that the opposite end of tilt plate 60 is attached to the previously-described gas cylinder receiver 12 of the chair 3 which projects downwardly from seat plate 14. By way of example, the tilt plate 60 has a coupling ring 64 which is located in surrounding engagement with the gas cylinder receiver 12 during the manufacture or assembly of the chair 3.

The operation of the dynamic lumbar support 1 within the back 20 of the chair 3 is now explained for providing support to the user's lower back and maintaining a proper posture whether the chair back stands upright and the user is sitting erect while working or the chair back tilts backwards and the user reclines. FIG. 1 shows the chair 3 rocked forward, the chair back 20 standing upwardly from the seat 5, and the user sitting erect so as to be close to the work surface. In this case, the resilient cushion back support 40 of the lumbar support 1 which is bonded to the normally curved force-receiving sheet 42 is at rest, and hide compressive force is applied thereagainst by the user's back. The tension adjustment knob 16 which lies below the seat plate 14 includes a spring (not shown) which automatically biases the chair back 2 to the upstanding position shown in FIG. 1 at which the tension on the tension strap 58 is maximized.

In its relaxed configuration shown in FIG. 1, the resilient cushion back support 40 has a generally thick, convex shape which protrudes forwardly from within the chair back 20 (best shown in FIG. 6) towards the user so as to fit comfortably within and provide support for the user's lower back. As previously explained, the normally curved (i.e., arced) nature of the flexible sheet 42 pushes the convex back support 40 into engagement with the user's back. To this end, the sheet bending rod 66 (of FIGS. 4 and 5) applies pressure to the bottom of the flexible force-receiving sheet 42 and urges the sheet 42 towards its normally curved configuration. By virtue of the foregoing, the convex cushion back support 40 maintains a proper back posture as the user is working adjacent the work surface. At the same time, the back pressure-responsive rod 50 of the lumbar support 1 lies at the bottom of the pair of guide tracks 56, and the tension strap 58 stands vertically and at full tension inside the chair back 20.

Figure 2:
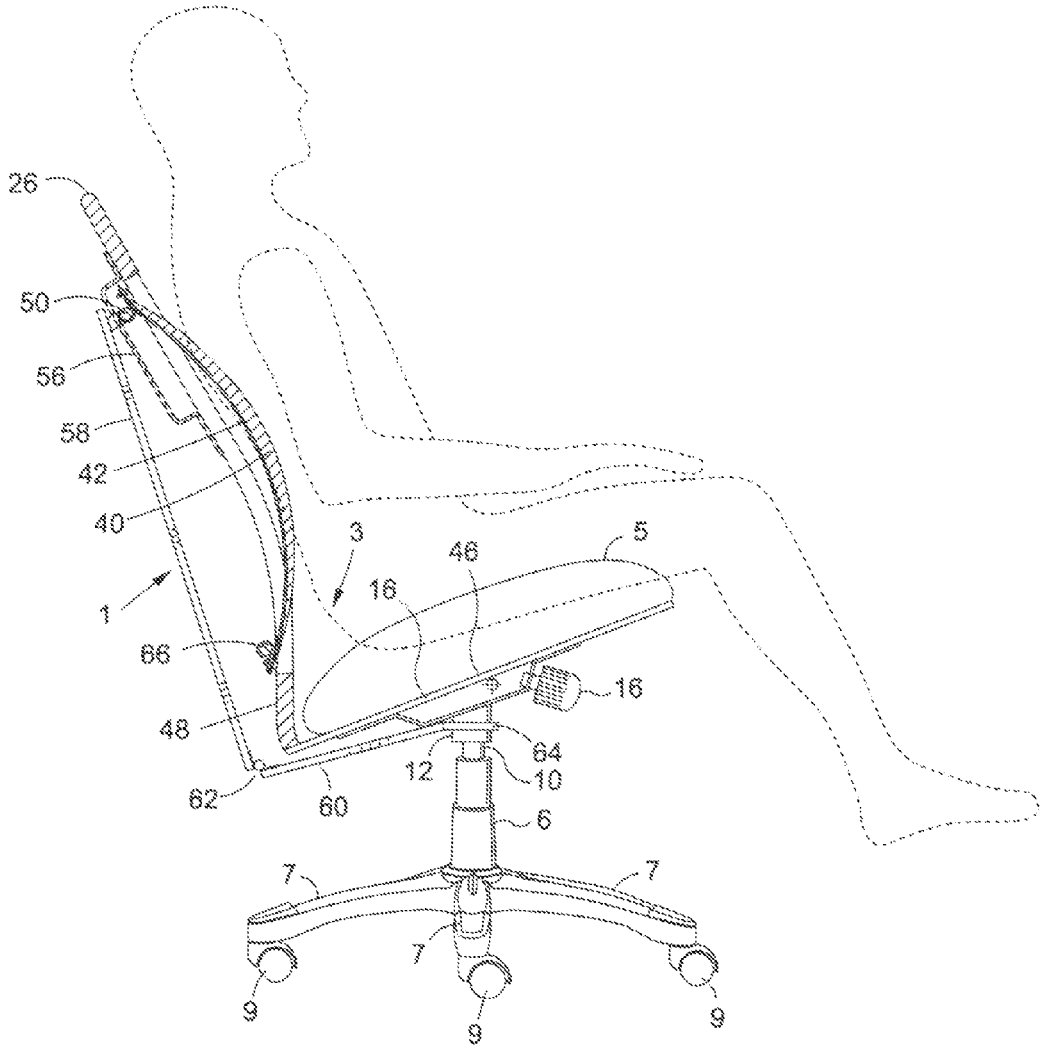
FIG. 2 is a side view of the chair of FIG. 1 with the cushion back support of the dynamic lumbar support being compressed and tautened when the user leans back in the chair and reclines away from die work surface.

FIG. 2 shows the chair 3 rocked back, the user reclining and shifting his weight against the chair back 20 and the chair back 20 tilting away from the work surface. In this case, a compressive force is generated by the user's back against the chair back 20 to cause the resilient cushion back support 40 to be compressed, in its compressed configuration as shown in FIG. 2, the shape of the formerly at-rest cushion back support 40 changes from being initially convex to a shape which is now substantially flattened so as to provide continuous support for the user's lower back. The normally curved (i.e., arced) flexible force-receiving sheet 42 attached to the rear of the cushion back support 40 follows the shape of the user's back so as to be pushed backwards and straightened. That is to say, the compressive force generated by the user's back against back support 40 overcomes the initially curved configuration of the flexible sheet 42 such that the sheet is stressed and energy is stored.

When the user shifts his weight and generates a compressive force against the chair back 20, the vertical tension strap 58 to which the back pressure-responsive rod 50 is attached is correspondingly pushed backwards and rotated (i.e., in a counterclockwise direction) relative to the stationary tilt plate 60 at the spring-loaded hinge 62. At the same time that the cushion back support 40 is compressed and flattened and the tension strap 58 rotates at lunge 62, the horizontally-extending back pressure-responsive rod 50 which is attached to the force-receiving sheet 42 of the back support 40 by brackets 52 is pulled by the rotating tension snap 58 so as to ride upwardly along the pair of guide tracks 56 and move vertically through the chair back 20. Moreover, as the flexible force-receiving sheet 42 is pushed back and straightened, the sheet bending rod 66 is caused to rotate within the axially-aligned lunges 67-1, 67-2, 67-3 and 67-4. Hence, the compressive force generated by the user's back against the chair back 20 is transferred to and dissipated by the upwardly moving rod 50 and the rotating sheet bending rod 66.

When the user shifts his weight forwardly in the chair 3 and the compressive force being applied to the chair back 20 terminates, the back pressure-responsive rod 50 will automatically move in an opposite direction with respect to the chair back 20 and ride downwardly along the guide tracks 56 to its original position shown in FIG. 1. What is more, the stressed and straightened force-receiving sheet 42 will relax and release its stored energy so as to recover to its initial normally curved (i.e., arced) configuration. In this same regard, the sheet bending rod 66 is rotated in hinges 67-1, 67-2, 67-3 and 67-4 to once again push the flexible sheet 42 against cushion back support 40. Accordingly, the substantially flattened resilient cushion back support 40 simultaneously expands and is returned by the flexible force-receiving sheet 42 to its initial at-rest convex shape of FIG. 1. What is more, the tension strap 58 rotates forwardly (i.e., in a clockwise direction) at hinge 62 to return it its initial vertical position inside the chair back 20, whereby to pull the pressure-responsive rod 50 downwardly along the guide tracks 56.

It has been explained when describing the preferred embodiment for the dynamic lumbar support 1 that the flexible force-receiving sheet 42 that is attached to the back support 40 is normally curved and then straightened or flattened in response to the user leaning against the chair back 2. However, the flexible force-receiving sheet 42 may also be normally flat and initially forced into an arced configuration by the position of the back pressure-responsive rod 50 and the sheet bending rod 66 when the chair back 2 is in the upright position of FIG. 1. When the user leans back and the chair is tilted, the force-receiving sheet 42 is then urged to its original flattened shape to relieve the initial stress and release the energy stored by being bent.

The invention claimed is:

1. A chair comprising:

a chair seat to support the weight of a user;

a chair base to hold the chair seat above the ground;

a chair back to support the back of the user and adapted to tilt forwards and backwards; and a dynamic lumbar support including a cushion back support having a first protruding shape that engages and supports the user's lower back when the user sits erect in the chair and the chair back tilts forwards, said cushion back support changing to a second flattened shape when the user reclines in the chair and leans back so that the chair back tilts backwards, a tilt pressure-responsive rod extending horizontally through said chair back and coupled to said cushion back support, a tension strap interconnected between said tilt pressure-responsive rod and the chair base, said tension strap rotating backwards relative to said chair base in response to the chair back tilting backwards to cause said tilt pressure-responsive rod to move up through the chair back and thereby apply a pulling force to said cushion back support to cause the shape of said cushion back support to change from its first protruding shape to its second flattened shape, and said tension strap rotating forwards relative to said chair base in response to the chair back tilting forwards to cause said tilt pressure-responsive rod to move down through the chair back and thereby apply a pushing force to said cushion back support to cause the shape of said cushion back support to change from its second flattened shape back to its first protruding shape.

2. The chair recited in claim 1, wherein the cushion back support of said dynamic lumbar support has a convex configuration at the first protruding shape thereof so as to fit within the lower back of the user when the user sits erect in the chair and the chair back tilts forward, said cushion back support being compressed to said second flattened shape when the user reclines in the chair and the chair back tilts backwards.

3. The chair recited in claim 1, wherein said dynamic lumbar support also includes at least one track extending within said chair back, said horizontally-extending tilt pressure-responsive rod riding up and down along said track depending upon whether the chair back tilts backwards or forwards and whether said cushion back support has said first protruding shape or said second flattened shape.

4. The chair recited in claim 3, wherein said dynamic lumbar support also includes a flexible sheet having first and opposite ends and covering said cushion back support to push said back support having said first protruding shape into engagement with the user's lower back, the first end of said flexible sheet being coupled to and moving with said tilt pressure-responsive rod relative to the opposite end of said flexible sheet when the chair back tilts backwards and the tilt pressure-responsive rod moves up through said chair back for correspondingly causing the shape of said cushion back support to change from the first protruding shape thereof to the second flattened shape.

5. The chair recited in claim 4, wherein said dynamic lumbar support also includes as sheet bending rod which extends horizontally through said chair back so as to lie against said flexible sheet and thereby urge said cushion back support covered by said flexible sheet into engagement with the user's lower back.

6. The chair recited in claim 4, wherein the chair back includes a rigid backing located therewithin and covered by upholstery, said one track along which said tilt pressure-responsive rod rides up and down being connected to said rigid backing, and the opposite end of the flexible sheet which covers said cushion back support also being connected to said rigid backing so that the first end of said flexible sheet moves with said tilt pressure-responsive rod relative to the opposite end of said flexible sheet by which the shape of said cushion back support changes between the first protruding shape thereof and the second flattened shape depending upon whether the back of the chair tilts backwards or forwards and whether said tilt pressure-responsive rod rides up or down along said track.

7. The chair recited in claim 6, wherein said rigid backing has an opening formed therein, said flexible sheet being located alongside said opening so that said cushion back support is received through said opening.

8. The chair recited in claim 1, wherein said tension strap is pivotally coupled to the base of said chair so that said tension strap rotates backwards and forwards relative to said base when the back of the chair rotates backwards and forwards.

9. The chair recited in claim 1, further comprising a gas cylinder receiver located below the chair seat, and a gas cylinder located between the base of the chair and the gas cylinder receiver to adjust the height of the chair seat, wherein said dynamic lumbar support also includes a base plate located below the chair seat and having one end thereof pivotally coupled to said tension strap and an opposite end coupled to the gas cylinder receiver so that the tension strap rotates backwards and forwards relative to said base plate when the back of the chair rotates backwards and forwards.

10. The chair recited in claim 9, wherein said tension strap rotates backwards and forwards at a hinge relative to said base plate at the same time that the chair back tilts backwards and forwards and said tilt pressure-responsive rod moves up and down through the chair back, said hinge located between said base plate and said tension strap.

11. A chair, comprising:

a chair seat to support the weight of a user;

a chair base to hold the chair seat above the ground;

a chair back to support the back of the user and adapted to tilt forwards and backwards; and a dynamic lumbar support including a cushion back support having first and opposite ends and a first shape that engages and supports the user's lower back when the user sits erect in the chair and the chair back tilts forwards, said cushion back support changing to a second shape when the user reclines in the chair and leans back so that the chair back tilts backwards, a tilt pressure-responsive rod extending horizontally through said chair back and attached to the first end of said cushion back support, a tension strap having first and opposite ends and being coupled at the first end thereof to said tilt pressure-responsive rod, and a base plate located below said chair seat and connected between said chair base and the opposite end of said tension strap, said tension strap rotating backwards and forwards relative to said base plate when the chair back tilts backwards and forwards to cause said tilt pressure-responsive rod to move up and down through the chair back such that the first end of said cushion back support which is attached to said tilt pressure-responsive rod also moves up and down relative to the opposite end of said cushion back support by which to correspondingly cause said cushion back support to change between the first and second shapes thereof.

12. The chair recited in claim 11, wherein the first shape of the cushion back support of said dynamic lumbar support is convex so as to protrude towards and fit within the lower back of the user when the user sits erect in the chair and the chair back tilts forward, the cushion back support being compressed such that the second shape thereof is flattened when the user reclines in the chair and the chair back tilts backwards, the tension strap rotates backwards with the chair back, and the tilt pressure-responsive rod moves up through the chair back.

13. The chair recited in claim 12, wherein the cushion back support of said dynamic lumbar support is manufactured from a resilient material that is responsive to a compressive force applied thereto, said cushion back support having said first convex shape when the user sits erect in the chair and the chair back tilts forward, and said cushion back support being flattened to have said second shape when the user leans back against the chair back to correspondingly cause the chair back to tilt backwards, the tension strap to rotate backwards with the chair back, and the tilt pressure-responsive rod to move up through the chair back.

14. The chair recited in claim 11, wherein said dynamic lumbar support also includes a track extending within said chair back, said horizontally-extending tilt pressure-responsive rod moving up and down through said chair back and along said track depending upon whether the chair back tilts backwards or forwards and whether the tension strap of said dynamic lumbar support rotates backwards or forwards relative to said base plate.

15. The chair recited in claim 14, wherein said dynamic lumbar support also includes a rigid backing attached to said chair back, each of said track and the opposite end of said cushion back support being fixedly connected to said rigid backing so that the first end of said cushion back support is pulled up through the chair back relative to the opposite end of said cushion back support when said tension strap rotates backwards and said tilt pressure-responsive rod moves up.

16. The chair recited in claim 12, wherein said dynamic lumbar support also includes a flexible sheet having first and opposite ends and covering said cushion back support, the first end of said flexible sheet being coupled to and moving with said tilt pressure-responsive rod relative to the opposite end of said flexible sheet when the chair back tilts backwards and the tilt pressure-responsive rod moves up through said chair back for correspondingly causing the shape of said cushion back support to change from the first convex shape thereof to the second flattened shape.

17. The chair recited in claim 11, wherein the opposite end of said tension strap is pivotally connected to said base plate below the seat of said chair so that said tension strap rotates backwards and forwards relative to said base plate when the back of said chair tilts backwards and forwards.

18. A chair, comprising:

a chair seat to support the weight of a user;

a chair base to hold the chair seat above the ground;

a chair back to support the back of the user and adapted to tilt forwards and backwards;

a cushion back support to engage the user's lower back being attached to said chair back and having first and opposite ends, said cushion back support having a first shape when said chair back tilts forwards and a second shape when said chair back tilts backwards;

a tilt pressure-responsive rod extending horizontally through said chair back and coupled to the first end of said cushion back support, the opposite end of said cushion back support being fixedly connected to said chair back;

a tension strap having first and opposite ends and coupled at the first end thereof to said tilt pressure-responsive rod; and a base plate located below the chair seat and connected between the chair base and the opposite end of said tension strap;

said tension strap rotating backwards relative to said base plate in response to said chair back tilting backwards to cause said tilt pressure-responsive rod to move up through said chair back and thereby apply a pulling force to the first end of said cushion back support so that the shape of said cushion back support changes from the first shape thereof to the second shape.

19. The chair recited in claim 18, further comprising a rigid backing located within the back of said chair and upholstery surrounding said rigid backing, the opposite end of said cushion back support being fixedly connected to said chair back at said rigid backing so that the first end of said cushion back support moves up through the chair back with said tilt pressure-responsive rod in response to said chair back tilting backwards.

20. The chair recited in claim 18, wherein the opposite end of said tension strap is pivotally connected to said base plate such that said tension strap rotates backwards relative to said base plate and said tilt pressure-responsive rod moves up through the chair back in response to the chair back tilting backwards.

* * * * *